US005285883A

United States Patent [19]

Le Hong et al.

[11] Patent Number: 5,285,883

[45] Date of Patent: Feb. 15, 1994

[54] AUTOMATIC PAYMENT DEVICE AND METHOD FOR RECOGNIZING COINS

[75] Inventors: Son Le Hong, Villebon sur Yvette; Claude Rigolet, Limours, both of France

[73] Assignee: Atoll Technology, Cedex, France

[21] Appl. No.: 6,993

[22] Filed: Jan. 21, 1993

Related U.S. Application Data

[62] Division of Ser. No. 849,564, Mar. 11, 1992, Pat. No. 5,232,399.

[51] Int. Cl.[5] ..... G07D 3/14

[52] U.S. Cl. ..... 194/317; 194/352; 453/3; 453/57

[58] Field of Search ..... 194/317, 318, 352; 453/3, 33, 34, 49, 57, 63; 221/182; 446/8-12

[56] References Cited

U.S. PATENT DOCUMENTS

| | | | |
|---|---|---|---|
| 788,585 | 5/1905 | Johnson . | |
| 1,210,732 | 1/1917 | Voglesong . | |
| 2,080,389 | 5/1937 | Rasmusen et al. . | |
| 2,348,936 | 5/1944 | Sprenger . | |
| 3,783,885 | 1/1974 | Williams et al. . | |
| 4,234,071 | 11/1980 | Le Hong . | |
| 4,548,220 | 10/1985 | Le Hong et al. . | |
| 4,752,274 | 6/1988 | Abe . | |
| 4,898,564 | 2/1990 | Gunn et al. | 453/3 |
| 4,960,196 | 10/1990 | Kanehara et al. | 194/352 X |
| 4,987,990 | 1/1991 | Perkitny | 446/9 X |
| 5,122,093 | 6/1992 | Perkitny | 446/9 X |

FOREIGN PATENT DOCUMENTS

| | | |
|---|---|---|
| 2128795 | 5/1984 | United Kingdom . |
| WO89/12872 | 12/1989 | World Int. Prop. O. . |

*Primary Examiner*—F. J. Bartuska

*Attorney, Agent, or Firm*—Young & Thompson

[57] ABSTRACT

Coins corresponding to a payment, thrown into a hopper, fall on a recessed disk and each lodge in one of the recesses. If two coins are superposed in one recess, the upper coin is deflected outwardly by a slot and then raised by the inclined bottom of this slot to finally be ejected from the recess. The coins are then, as a function of the result of a detection, oriented toward one or the other of two compartments of an annular display which surrounds the separation disk. At the end of each payment, the annular display turns a fraction of a turn to bring the two compartments into a presentation position, while two empty compartments are presented to receive the following payment, and the coins corresponding to the preceding payment arrive at a transmission position for example toward collection boxes. The drive of the movable portion of the display is effected by its radially outer edge. The central portion comprising the separator disk and its drive motor can swing downwardly to eject foreign bodies In case of a questioned coin, or if the movable portion of the display is in the course of rotation, the coin is returned to the detector instead of proceeding to the display.

17 Claims, 9 Drawing Sheets

AUTOMATIC PAYMENT DEVICE AND METHOD FOR RECOGNIZING COINS

Figure 1:
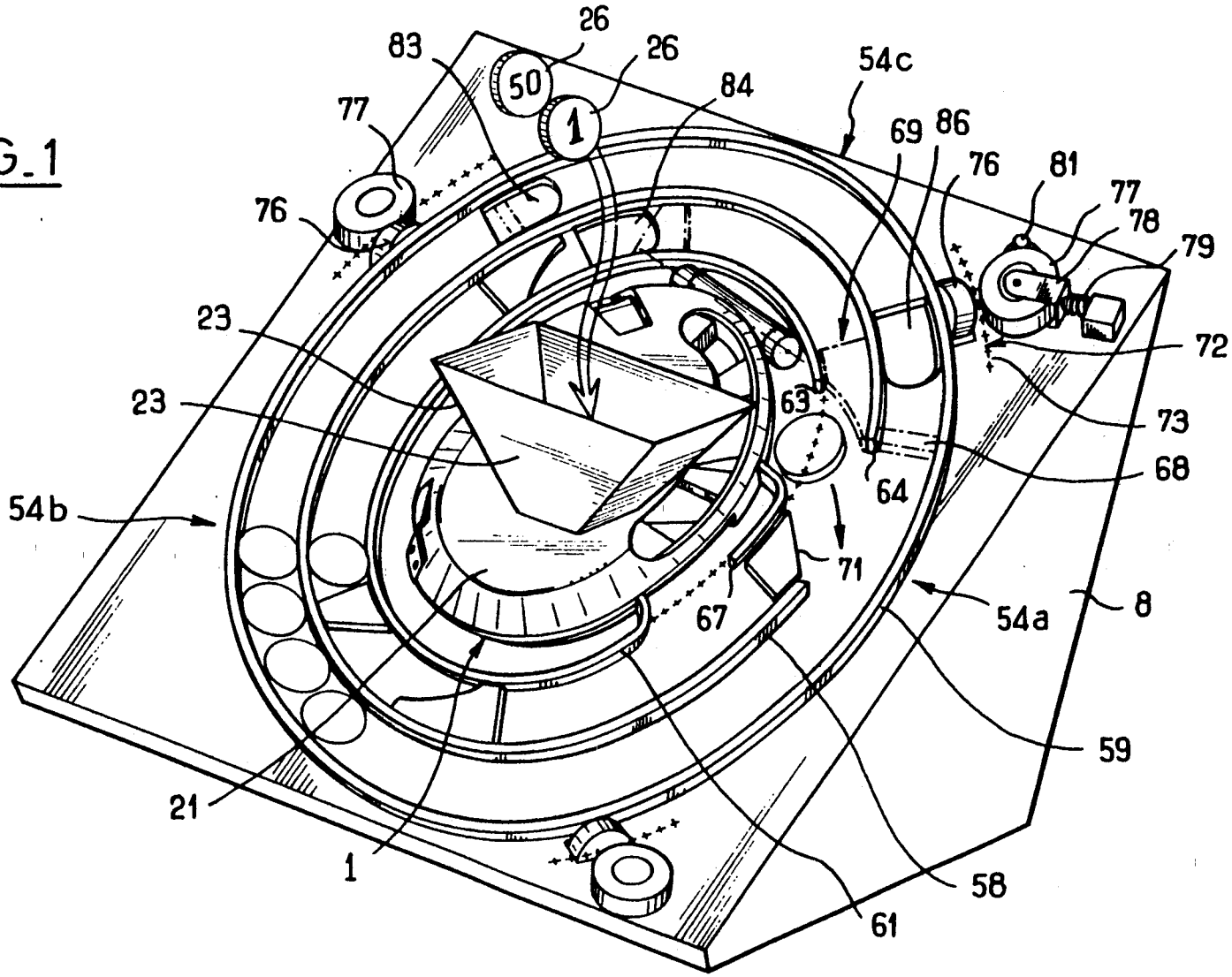

This application is a division of application Ser. No. 07/849,564, filed Mar. 11, 1992, now U.S. Pat. No. 5,232,399.

The present invention relates to devices for the separation of coins, tokens and the like, adapted to be included for example in an apparatus for automatic payment.

The present invention also relates to such apparatus.

There is known from EP-A-0420921 an apparatus for automatic payment in which a separator disk receives on its upper surface the coins or tokens to be separated and comprises at its periphery recesses adapted each to receive a coin or token. To this end, the recesses open through the upper surface of the disk. They also open opposite a stationary peripheral wall forming the lateral guide wall for the coins or tokens driven in rotation by the recesses. Along this path, the coins slide on a fixed conveying surface. They pass through the field of action of a detector. They then reach an opening for passage toward a circular display situated beside the rotatable disk. As a function of the result of the detection effected by the detector, the passage opening is configured according to one or the other of two different configurations directing the coins or tokens either toward a peripheral compartment of the display or toward a central compartment. There are three central compartments and three peripheral compartments. When one presentation region comprising a central compartment and a peripheral compartment is in position to receive the coins or tokens coming from the separator disk through the passage opening, another presentation region comprising another peripheral compartment and another central compartment is in a presentation position, in which the coins or tokens corresponding to a preceding payment are visible to users, while a third presentation region, comprising the third peripheral compartment and the third central compartment, is located in a position for transmitting the coins or tokens toward a final station, for example a storage box of the coins or tokens, a device to return the rejected coins or tokens, et cetera.

On the disk, a knockdown bar is adapted to prevent the superposed coins from reaching the detector. But as the knockdown bar must be placed a sufficient distance from the conveying surface to permit the passage of the thickest coins, this bar is in certain cases incapable of preventing the simultaneous passage of two thin coins which will become lodged in the same opening In any event, if the second coin extends above the upper surface of the disk, it is dangerous to attempt to dislodge it by the knockdown bar because that risks causing a blockage and damage. This problem cannot be solved by making the disk thinner, because that would permit a thin coin to pass between the upper surface of the disk and the knockdown bar.

Other disturbances in the rotation of the disk can arise, particularly if foreign bodies have entered the chamber in which the disk turns. These foreign bodies can become lodged between the disk and the knockdown bar, or below the detector, between the disk and the bottom wall, or even in the movable members defining the configuration of the passage opening. In such a case, cleaning the known apparatus can consume a certain time and accordingly give rise to undesirable disturbance of the proper operation of the entire payout station.

It can happen that certain coins will be questionable, which is to say that the response of the detector to the passage of the coin differs only very little from the response corresponding to a genuine coin. Such a coin can be rejected by the apparatus. This give rise to an unnecessary disturbance of the operation if in fact it involves for example a very worn but still genuine coin.

Finally, in the known apparatus, the presentation device is fairly bulky because its diameter is greater than that of the separation device and it is necessary accordingly more than to double the area necessary to position side-by-side the two devices, relative to that which would be required by a single separation device.

The object of the present invention is to overcome these drawbacks.

According to a first object of the invention, there is provided a device for the separation of coins, tokens or the like, comprising a movable member provided with successive recesses opening opposite a fixed lateral guide wall and through the upper surface of the movable member, in which the lateral guide wall comprises a notch for forming into single file the coins, tokens or the like, this notch being open toward the movable member and comprising an inclined bottom which, when moving along it in the direction of movement of the openings facing the notch, proceeds from a lower region situated higher than a conveying surface for the coins, tokens or the like, but lower than the upper surface of the movable member, to an upper region farther from the conveying surface.

When a superposed coin arrives facing the notch, it deviates laterally from its path thanks to the notch while continuing to be driven by the rear edge of the recess in which it is disposed It follows the inclined bottom of the notch which raises it progressively until the point of its periphery which was in contact with the rear edge of the recess passes above the upper surface of the movable member, which finally dislodges the superposed coin from the recess which it occupied. The lower coin continues to be driven normally because the bottom of the recess is at all times a certain distance above the conveying surface on which the coins slide that are driven by the recesses.

To raise without fail the superposed coins to a height such that they leave the recess that they occupied, it can be provided that the upper region of the inclined bottom of the notch is at a distance at least equal to or even greater than that of the upper surface of the movable member relative to the conveyor surface on which the coins slide. However, if the speed at which the coins or tokens are driven is high, the upper region of the bottom of the notch can be relatively little spaced from the conveyor surface, the bottom of the notch then having the function of a springboard adapted to cause the coin to jump to a height greater than that of the upper region of the bottom of the notch.

According to another object of the invention, there is provided an automatic payment device comprising a separator having a disk which is provided with recesses, to receive coins or tokens and which is movable in rotation to cause the coins or tokens to file through the field of action of a detector, and then opposite at least one passage opening toward a display which comprises partitions to define several display regions for the coins or tokens, and drive means of the partitions to cause these regions to move cyclically to a position to receive the coins or tokens coming from the separator and then to a position for the transmission of the coins or tokens to a following station, such as a collection box, in which the display is an annular display disposed about the disk, drive means effecting the cyclical displacement of the display regions about the disk.

There is thus effected a substantial reduction of size. Moreover, the passage of the coins or tokens from the separator disk toward the display, is substantially facilitated and can be effected at all points about the periphery of the disk and of the internal periphery of the display. The distance to be covered by the coins or tokens between the disk and the display is also as short as possible. As a result, if this displacement is effected by gravity, the offset in height between the point at which the coins leave the disk and that at which they reach the display is also greatly reduced. This all facilitates the concept and reduces the size.

According to a third object of the invention, there is provided a device for the separation of coins, tokens or the like, comprising a rotatable disk provided with successive peripheral recesses, to receive the coins, tokens or the like, means to move the coins, tokens or the like along the upper surface of the disk so that they distribute themselves in the openings when the disk is in a service position in which said disk is generally situated in a plane forming a first acute angle with the vertical, and a motor having an output shaft connected to the disk to drive the disk in rotation, in which the disk is supported in rotation by a mounting to which is secured, at least indirectly, the motor housing, and said mounting is articulated to a structure of the device so as to be movable between a service position in which the disk is in service position, and a discharge position in which the disk is generally situated in a plane forming with the vertical a second acute angle smaller than the first angle.

When the mounting is in the discharge position, the disk will be located in a plane almost vertical, and it easily discharges by gravity foreign bodies which could be located on it.

As the motor is supported by the articulated mounting, the mobility o-f the mounting does not give rise to any particular complication of the structure. Moreover, even in the discharge position, it is still possible to turn the disk, particularly to aid in the expulsion of foreign bodies which encumber it.

If there is provided an actuator to displace the mounting in at least one direction of its movement between the service and discharge positions, the other direction of movement being for example effected by gravity, it is possible to shake the mounting of the disk by means of the actuator to promote the fall of foreign bodies.

According to a fourth object, there is provided a process for the recognition of objects of the type of coins, in which the coins are caused to pass one by one through the field of action of a detector which is part of a recognition device, and as a function of the response of the detector to the passage of each object, the object is directed selectively toward at least one outlet of the recognition device and respectively the object is returned to the field of action of the detector.

Other features and advantages of the invention will become apparent from the following description, relative to non-limiting examples.

Figure 2:
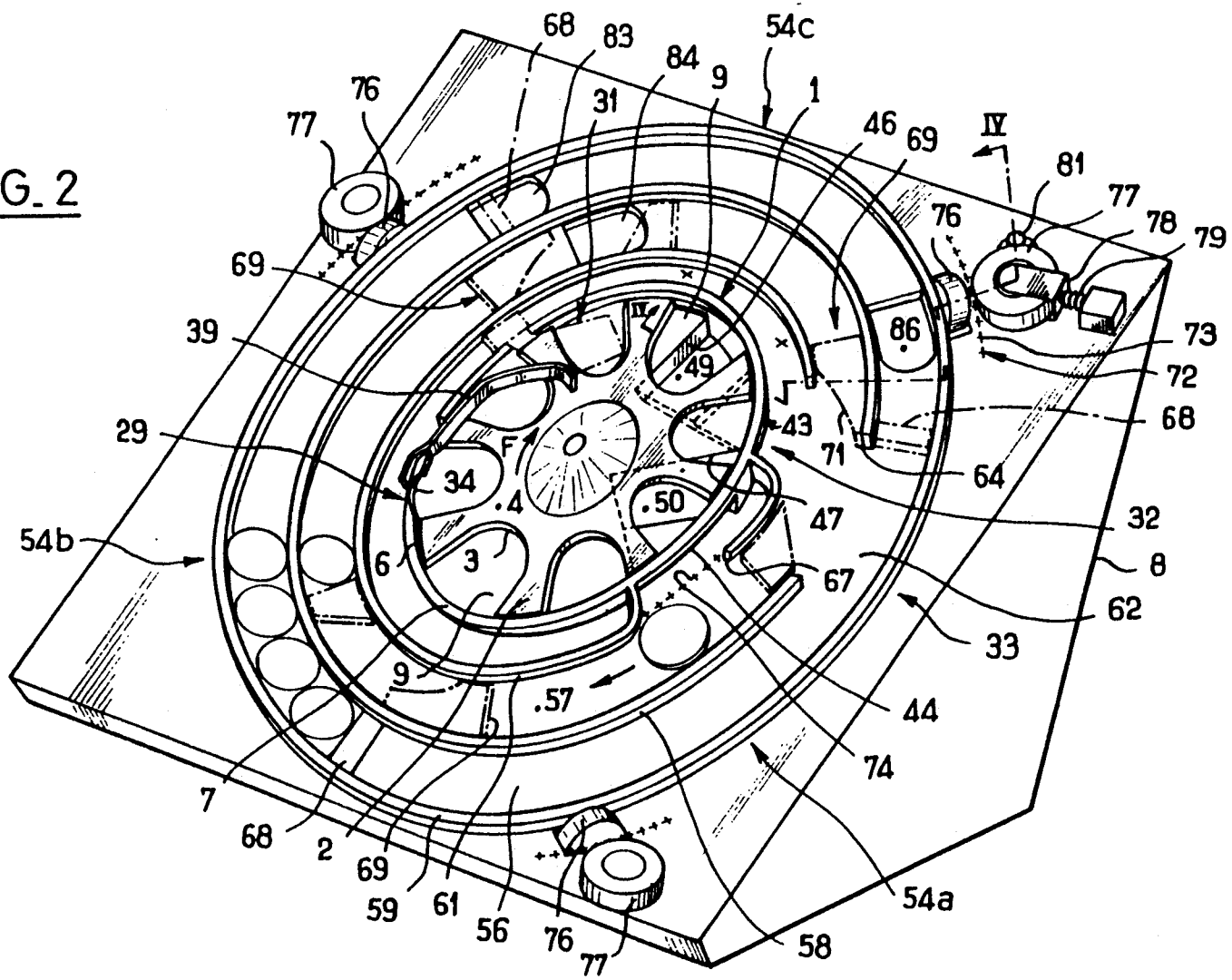
Figure 3:
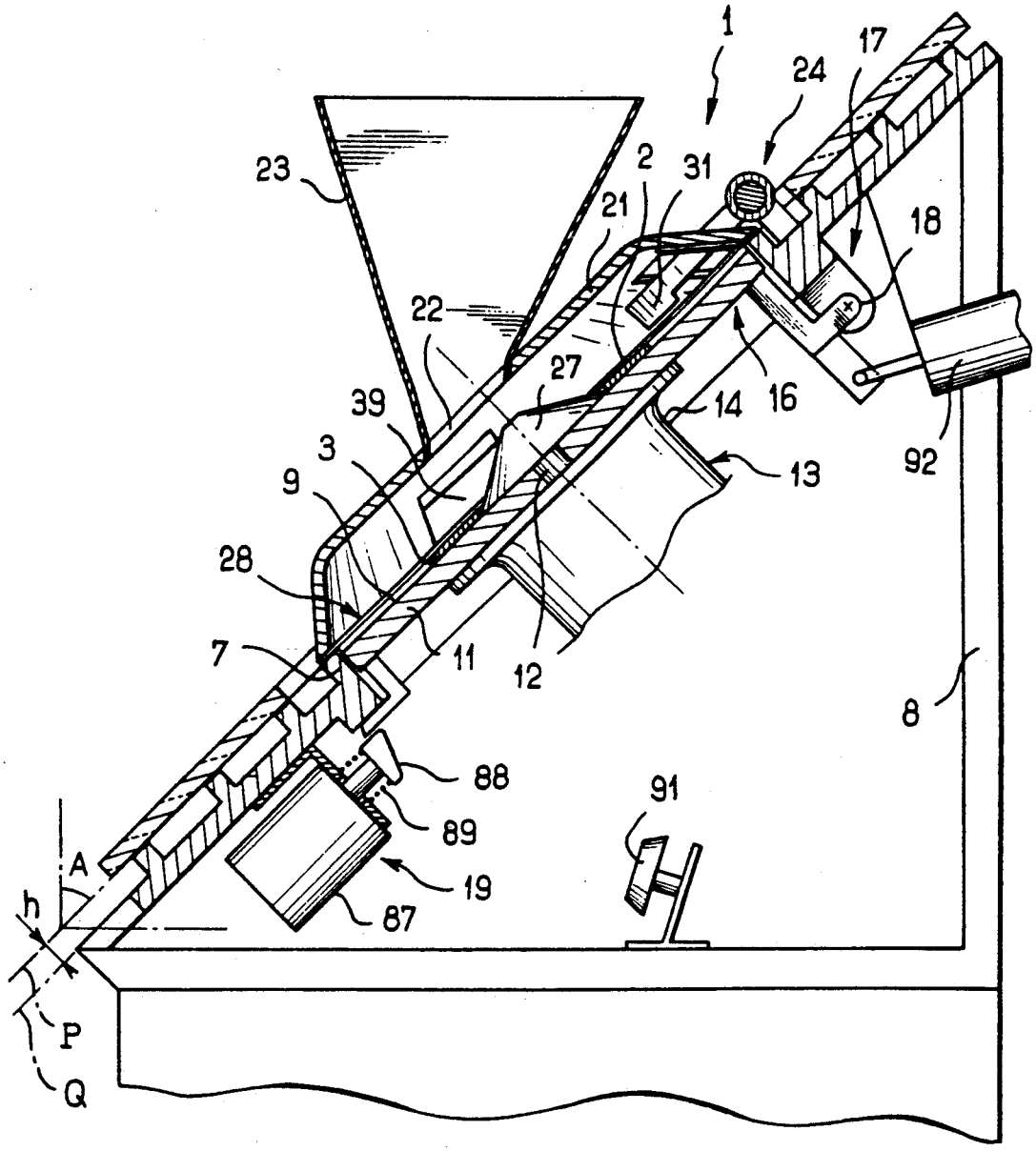
Figure 4:
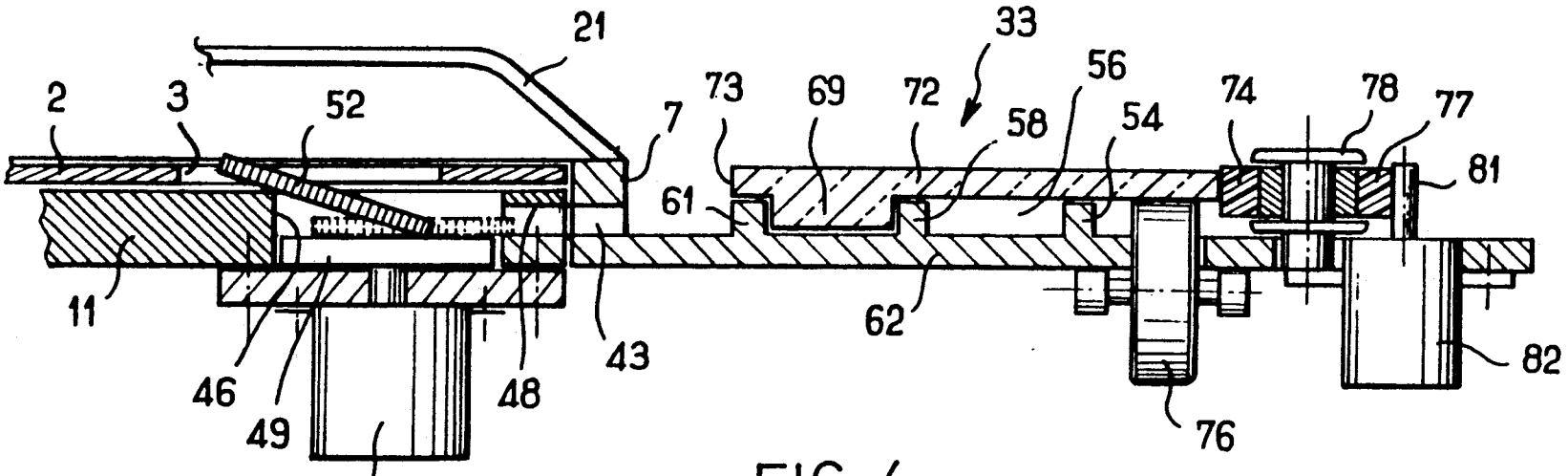
Figure 16:
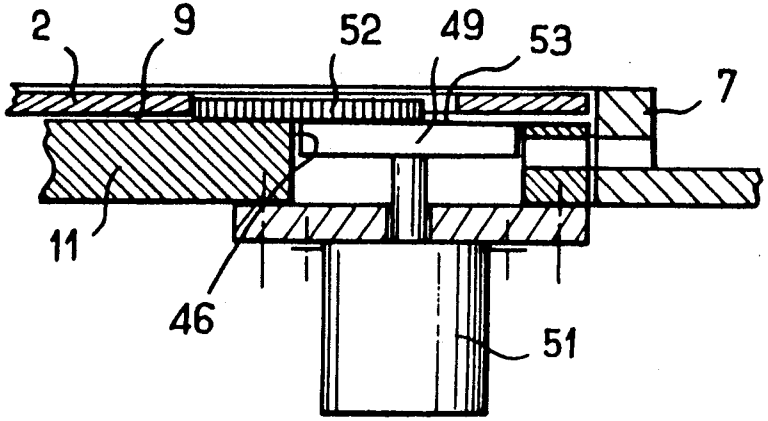
Figure 5:
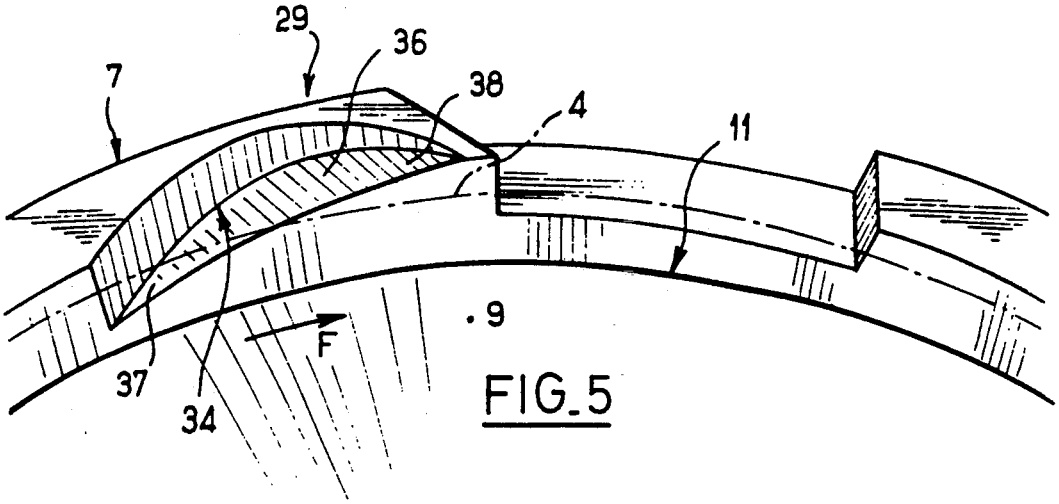
Figure 6:
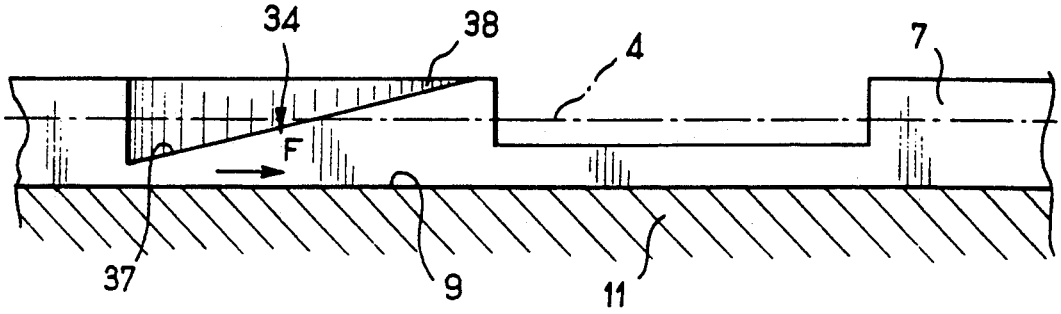
Figure 7:
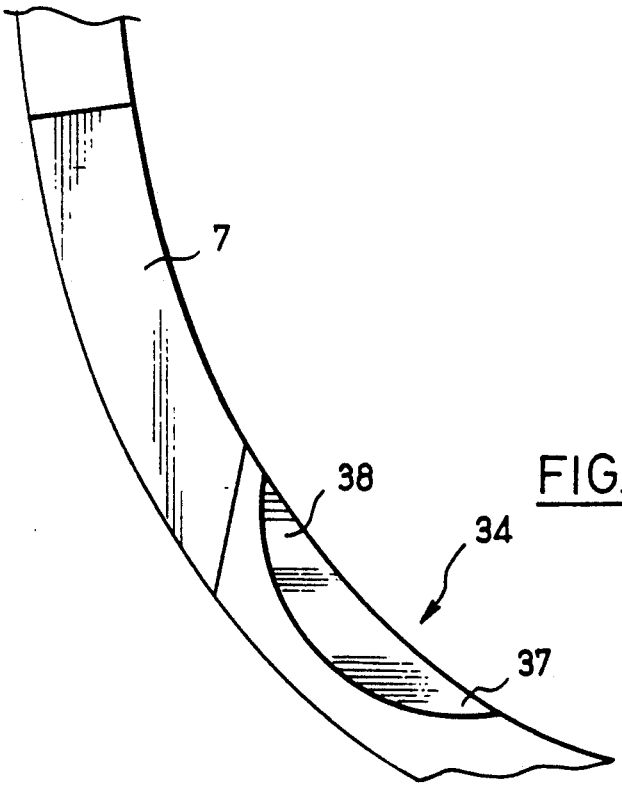
Figure 9:
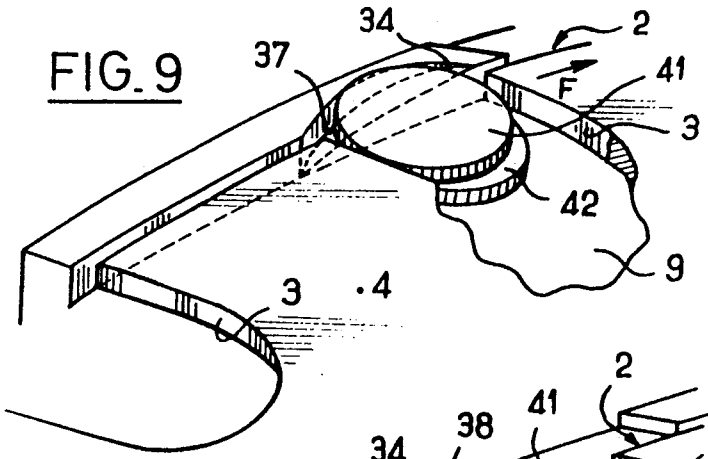
Figure 12:
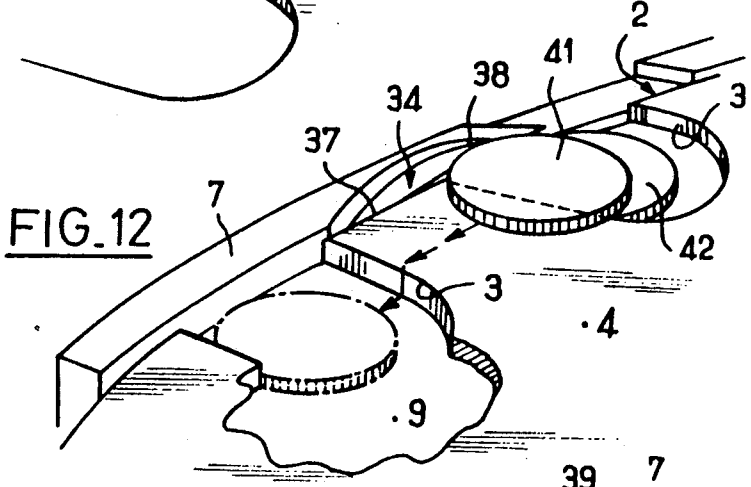
Figure 13:
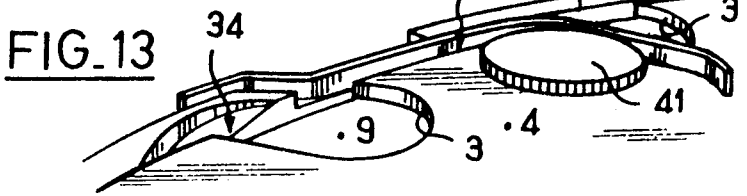
Figure 10:
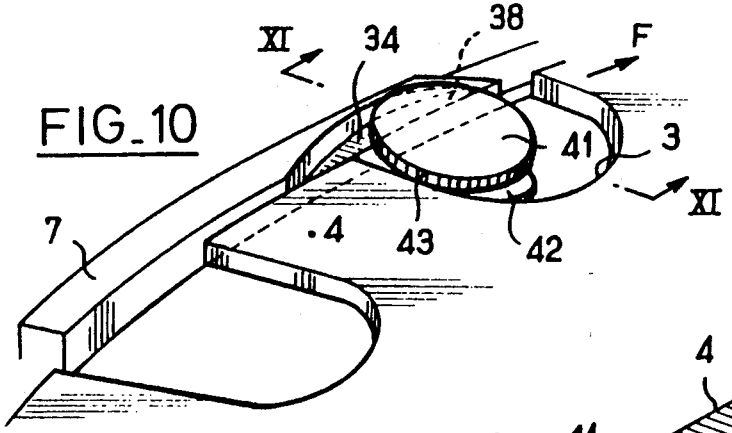
Figure 11:
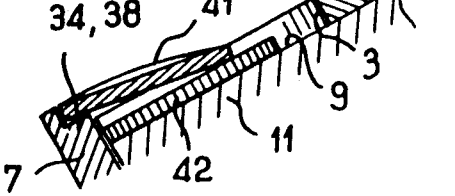
Figure 14:
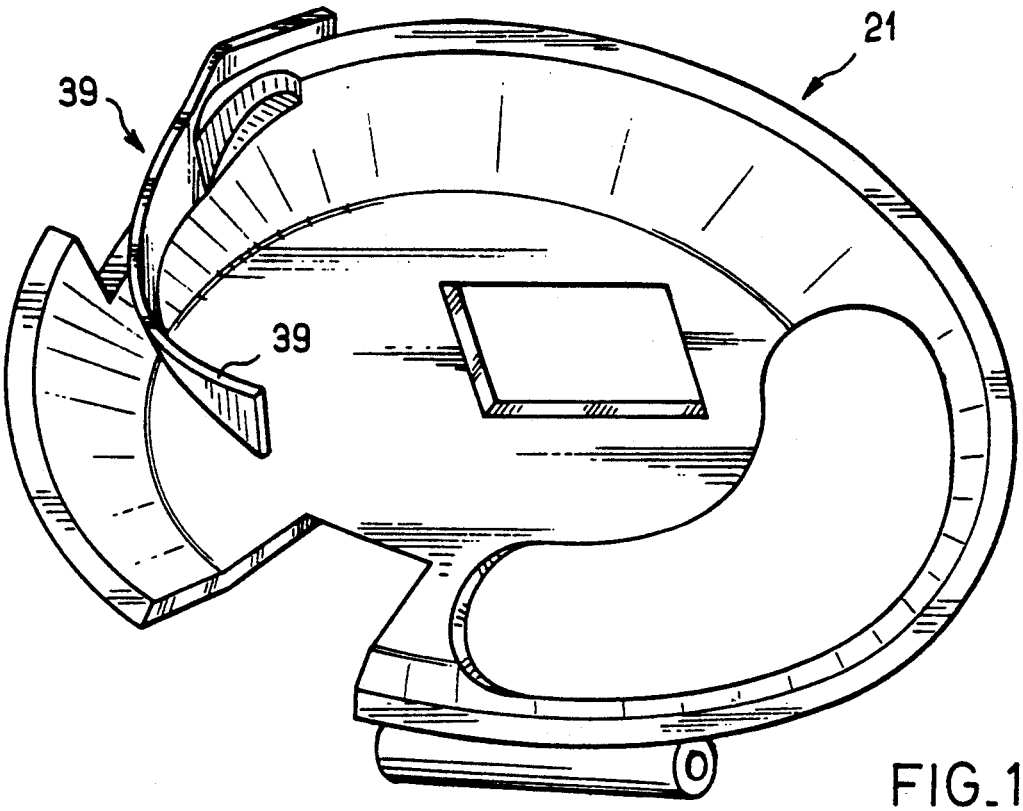
Figure 15:
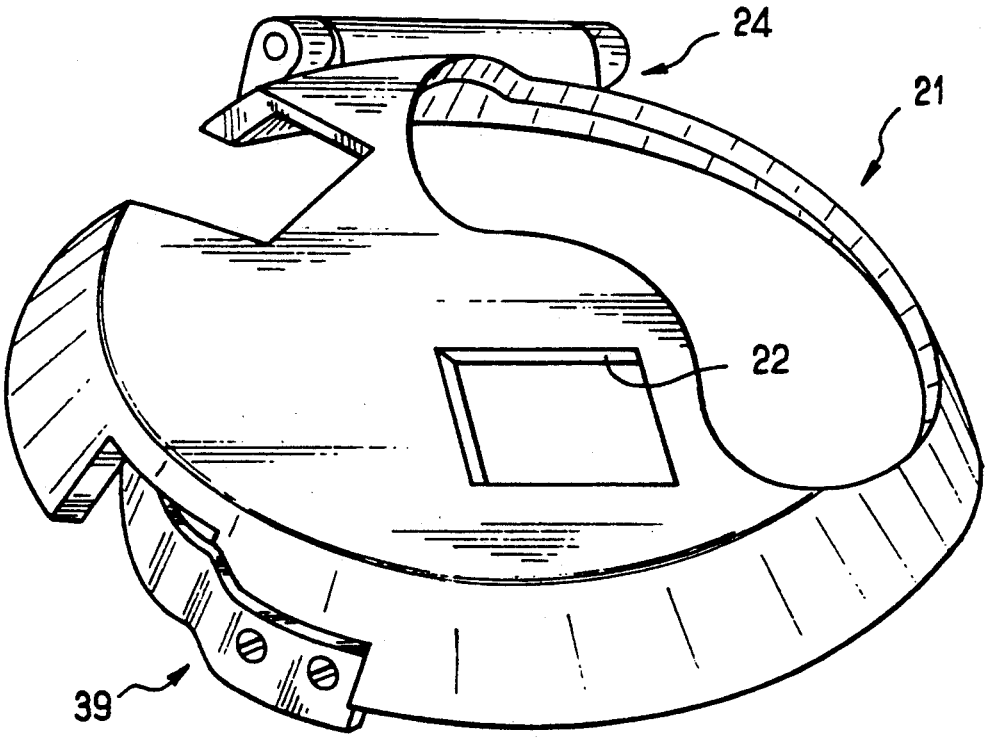
Figure 17:
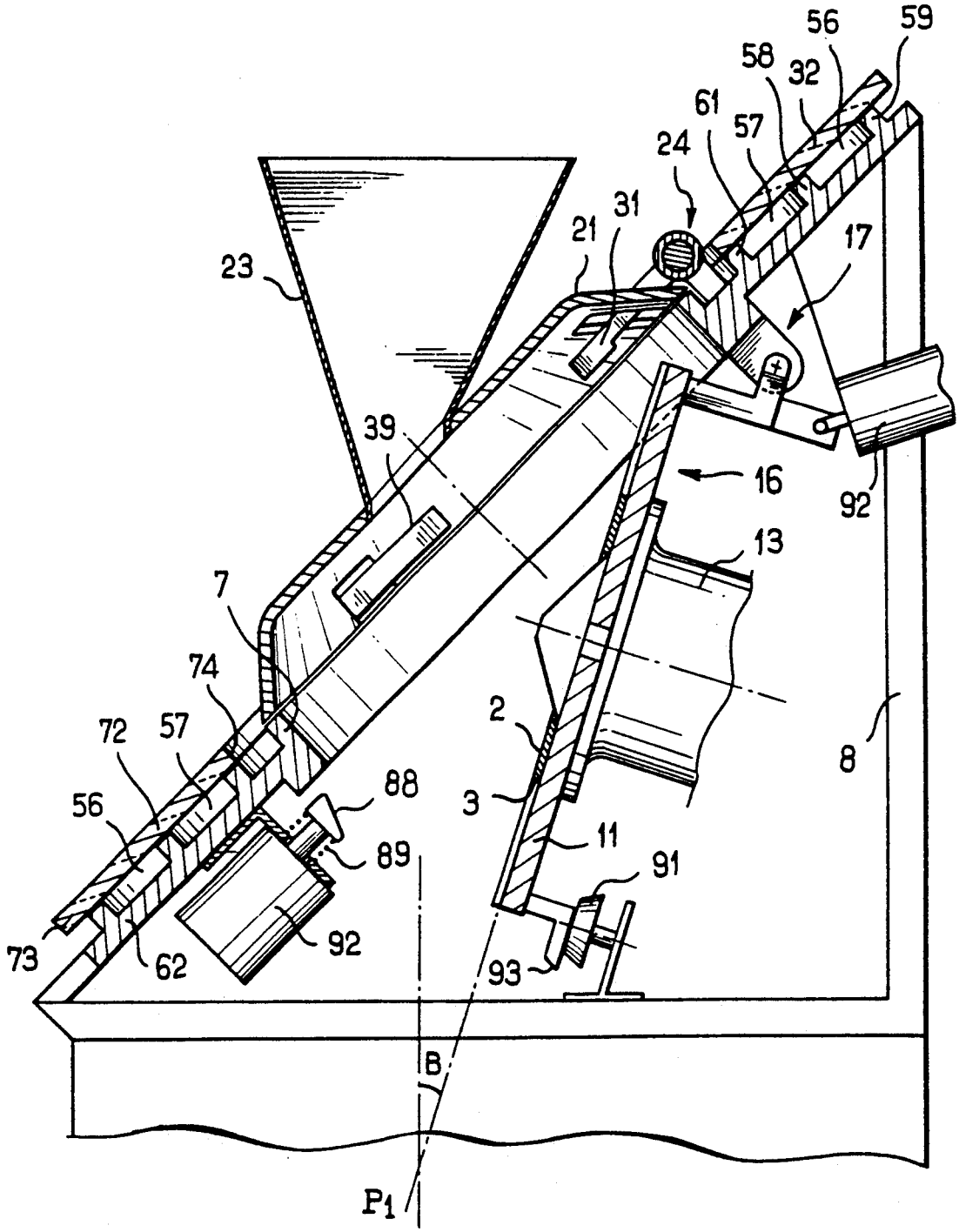
Figure 18:
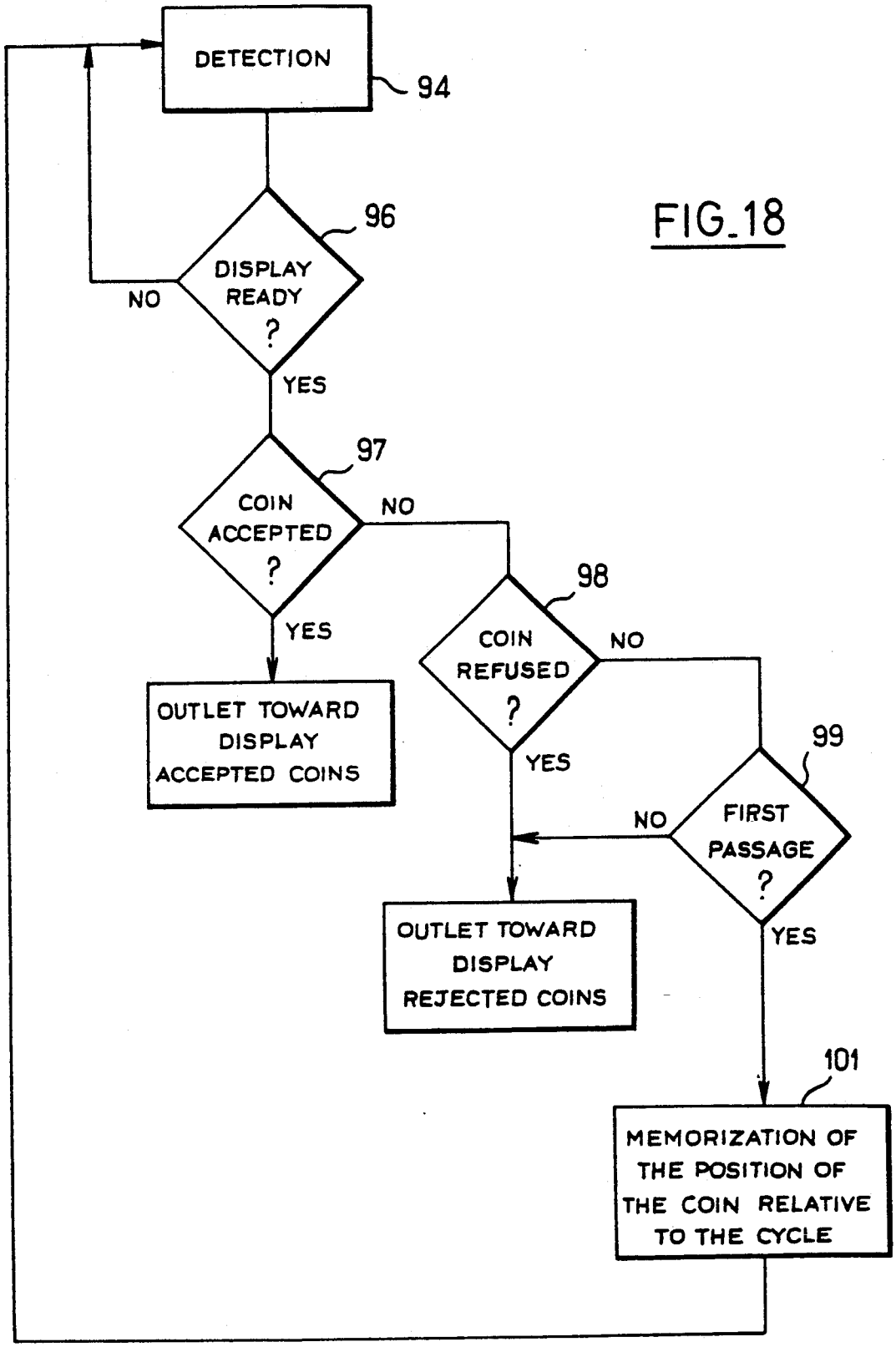

In the accompanying drawings:

- FIG. 1 is a schematic perspective view of an automatic payment apparatus according to the invention;
- FIG. 2 is a view similar to FIG. 1 when the cover of the separator is raised;
- FIG. 3 is a schematic view of the apparatus in axial cross section;
- FIG. 4 is a view in cross section on the line IV—IV of FIG. 2, showing the cover of the separator, during passage of a coin from the separator toward the display;
- FIG. 5 is a perspective view of a portion of the bearing wall and of the lateral guiding wall of the separator;
- FIG. 6 is an elevational view of this portion of the lateral guiding wall, with the bearing wall in cross section;
- FIG. 7 is a plan view of the same portion of the lateral guiding wall;
- FIGS. 8, 9, 10 and 12 show four successive stages of the ejection process of a superposed coin;
- FIG. 11 is a cross-sectional view along the line XI—XI of FIG. 10;
- FIG. 13 is a perspective view showing the knock-down blade in the course of preventing a coin from proceeding toward the detector without being lodged in a recess;
- FIGS. 14 and 15 are two perspective views showing respectively the inner surface and the outer surface of the cover;
- FIG. 16 is a detail view of FIG. 4 in the case in which a non-admitted coin is thus prevented from passing from the separator toward an outer compartment of the display;
- FIG. 17 is a view similar to FIG. 3 but when the mounting is in the discharge position;
- FIG. 18 is an operational diagram of the shunting of the coins.

As shown in FIGS. 1 to 3, the payment apparatus comprises a separator 1 comprising in its turn a disk 2 which, in the service position shown in FIGS. 1 to 3, is located in a plane P (FIG. 3) forming an angle A of about 45° with the vertical. The disk 2 comprises on its periphery recesses 3 which open through an upper surface 4 of disk 2 and through its peripheral edge 6, opposite a lateral guide wall 7 which is secured to a frame 8 of the apparatus. The bottom of the recesses 3 is closed by a carrier surface 9 for the coins or tokens, constituted by the upper surface of a bottom plate 11 (FIG. 3). The disk 2 is connected for rotation with the output shaft 12 of an electric motor 13 whose housing 14 is secured to the lower surface of the plate 11. The plate 11 is part of a mounting 16 which is connected to the frame 8 of the apparatus by an articulation 17 which is adjacent an upper region of the disk. The axle 18 of the articulation 17 is substantially horizontal and parallel to plane P. In the service position shown, the mounting 16 is locked by a locking device 19 diametrically opposed to the articulation 17, and which renders unitary the mounting 16 with the frame 18 of the apparatus.

Separator 1 also comprises a cover 21 traversed by the outlet opening 22 of a hopper 23 into which users toss coins, tokens or the like. The cover 21 is connected to the frame 8 of the apparatus by an articulation 24 which is adjacent the articulation 17 and to the upper region of the disk to permit raising the cover 21 and the hopper 23 when it is necessary to have access to the disk 2, particularly for maintenance.

The coins 26 (FIG. 1) which are tossed into the hopper 23 encounter a conical central reinforcement 27 (FIGS. 2 and 3) of the disk 2 and then are diverted toward the lower region 28 of the disk 2, while being prevented from falling lower by the cover 21. Certain coins lodge in recesses 3 which are in the lower region 28 of the disk and the coins are moved upwardly in the direction of arrow F of FIG. 2 by the rotation of the disk 2. This rotation also brings to the lower position new recesses in which other coins lodge and so on until the assembly of coins corresponding to the payment which has been made will be driven upwardly by the recesses 3 in the direction of the arrow F.

In the course of this movement, the coins pass through a knockdown station 29 (FIG. 2) and then through the field of action of an ejector 31 which is shown only in broken line in FIG. 2 and which is for example of the type described in EP-A-0 420 921, in which case it is disposed above the path of the coins or tokens eccentrically of this path, then finally through a distribution station 32 for the coins or tokens proceeding to a display 33 which will be described in greater detail later.

The knockdown station 29 comprises (FIGS. 5, 6, 7) a notch 34 which is provided in the inner peripheral surface and in the upper surface of the lateral guide wall 7. The notch 34 is thus open toward the disk 2 of which only the upper surface 4 is shown in broken line in FIGS. 5 and 6.

The notch 34 comprises an inclined substantially flat bottom 36. What moves along the bottom 36 in the direction of rotation of the disk (arrow F), moves from a lower region 37 of the bottom to arrive at an upper region 38. The lower region 37 of the bottom 34 is located higher than the carrier surface 9 of the bottom plate 11 and lower than the upper surface 4 of the disk 2. The upper region 38 is spaced farther from the carrier surface 9 than the lower region 37. In the illustrated example, the upper region 37 is even slightly farther from the carrier surface 9 than the upper surface 4 of the disk.

Moreover, moving along the notch in the direction F of passage of the recesses, the lower region 37 of the notch widens radially and then the upper region 38 narrows radially.

It should also be noted that the notch 34 is located facing a rising region of the path of the recesses, and more particularly in the first part of the rising path of the recesses, such that the carrier surface 9 and the upper surface of the disk incline toward the lateral guide wall 7 in the region of the notch 34.

A knockdown blade 39 is secured to the cover 21 (see FIG. 2 and also FIGS. 14 and 15) so as to come into contact or quasi-contact with the upper surface 4 of the disk 2 at a place which is located behind the notch 34 relative to the direction of movement of the recesses, shown by the arrow F. The relative arrangement of the notch 34 of the knockdown blade 39 is visible in FIG. 2 and FIG. 13. The knockdown blade 39 is adapted to prevent the passage of objects which would project significantly relative to the upper surface 4 of the disk 2. However, the knockdown blade 39 is elastic to avoid mechanical shocks with said objects.

There will now be described with reference to FIGS. 8 to 13, the operation of the knockdown station.

Figure 8:
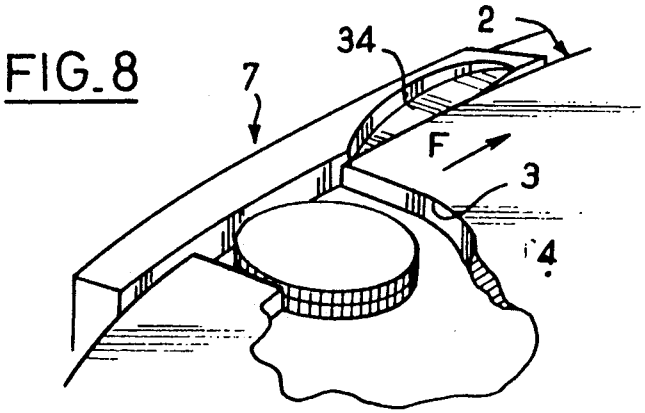

This station has essentially for its object to prevent these causes of malfunction: the presence of two superposed coins in the same recess 33 of the disk 2 (FIG. 8); and the presence of coin 41 or other object resting on the upper surface 4 of the disk 2 as is shown in FIG. 13. The distance between the knockdown blade 39 and the carrier surface 9 should be sufficient to permit the passage of the thickest coins beneath the blade 39. Moreover, the distance between the blade 39 and the upper surface 4 of the disk 2 should be sufficiently small to prevent the passage of the thinnest coins that could be received by the apparatus. As a result, the disk 2 should have a certain minimum thickness which cannot be reduced and this minimum thickness permits two thin coins to be moved in superposition in the same recess 3 (FIG. 8).

When two coins thus superposed arrive at the notch 34, the upper coin 41, which will hereinafter be called "the superposed coin" deflects radially outwardly relative to the other and enters the notch 34 (FIG. 9). This results from the fact that the superposed coin 41 is subjected, in this example, to the cumulative effect of centrifugal force, because of the rotation of the disk 2, and of gravity because the carrying surface 9 inclines toward the notch 34. The lower region 37 of the bottom of the notch 34 is sufficiently near the carrier surface 9 to permit the radial sliding of the superposed coin 41 even if the subjacent coin 42 is particularly thin. But as the lower region 37 is all the same at a certain distance from the carrier surface 9, the subjacent coin 42 cannot penetrate the notch 34.

As the two coins 41 and 42 continue to be moved by the disk 2, the superposed coin 41 travels along the bottom of notch 34 and thus reaches the upper region 38 of this bottom, which separates it from the subjacent coin 42 and raises it until the point 43 on the superposed coin 41 on which bears the edge of the recess 3 to push the coin 41 in the direction F, passes above the upper surface 4 of the disk (FIGS. 10 and 11.) When this happens, the superposed coin 41 escapes from the recess 3 (FIG. 12). As this takes place in an ascending region of the path of the recesses, the superposed coin 41 tends to return rearwardly relative to the disk and lodge in the following recess if this is free.

But there is the risk that there may arise between the superposed coin 41 and the upper surface 4 of the disk an adhesive contact which would move the coin 41 into the field of detector 31 (FIG. 2) before it had time to lodge in a following recess 3. The knockdown blade 39 (FIG. 13) avoids this risk and stops the coin 41 before it reaches the detector. The blade 39 has a deflector shape which displaces the coin 41 toward the center of the disk, after which the coin 41 can fall toward the lower region of the disk and occupy a new recess.

The detector 31 recognizes the coin, or on the other hand detects that the coin or other token which has been introduced does not correspond to a known type, or at least it gives a doubt response, which situation will be considered later. The detector 31 is disposed above the end of the ascending path of the recesses. The distribution station 32, which follows, is essentially disposed in the first half of the descending path of the recesses.

The distribution station 32 (FIG. 2) comprises a passage opening 43 for the coins which, as a function of the result of the detection performed by the detector 31, are considered as genuine, and, after the opening 43 in the direction of rotation F of the disk 2, a passage opening 44 for the coins which have been recognized as spurious by the detector 31. The openings 43 and 44 are provided through the lateral guide wall 7 facing a recess 46 or 47, respectively, provided in the carrier surface 9.

Each recess 46 or 47 communicates with the passage opening 43 or 44 associated with a respective tunnel 48 (FIG. 4) provided in the plate 11. A trap 49 fixed to the armature of an electromagnet 51 for actuating this trap is movable to be able to occupy a disengagement position (FIGS. 2 and 4) in which the trap is retracted downwardly to disengage the recess 46 and thus permit the coins 52 contained in the recesses to fall into the recess 46 then to pass by gravity through the tunnel 48 and the passage opening 43 in the direction of the display 33. To permit this movement by gravity, the tunnel 48 has an oblique orientation relative to the local radial direction such that the path of the coins from the recess 46 to the display will be generally descending thanks to the inclination of plane P.

In another position, or closure position (FIG. 16) the trap 49 closes the recess 46 such that the upper surface 53 of the trap 49 completes without significant discontinuity the carrier surface 9 of the plate 11. The electromagnet 51 is controlled to dispose the trap 49 in the closure position to the passage of a recess 3 of the disk 2 when the detection performed by the detector 31 has revealed that the coin 52 is not of a type recognized by the apparatus or that the coin 52 has not been identified with certainty. In this case, a coin such as 52 continues its path along the lateral guide wall 7 until it encounters the second recess 47, which is provided, in a manner identical to the first recess, with a trap 50 (in closed position in FIG. 2) controlled by an electromagnet If the coin is recognized as unacceptable, this second trap 50 is open and the coin falls through it to leave toward the display 33 through the passage opening 44 after having traversed a tunnel similar to tunnel 48 of FIG. 4. If the coin is questionable, trap 50 of the second recess 47 is closed and the coin is once more moved by the disk 2 toward the detection means.

A coin which is located opposite the passage openings 43 or 44 during rotation of the display 33, which rotation will be explained later, is also returned to the field of action of the detector, to avoid the coin interfering with the rotation of the display.

This process is explained by the operation diagram of FIG. 18. The step 94 "detection" comprises the detection by the detector 31. The test 96 verifies whether the display 33 is ready or if on the contrary it is moving. In the second case, the coin is returned to the detection (step 94) which is to say that the two traps 49, 50 are maintained closed. If the display 33 is ready, the result of a detection is subjected to a test 97. If the coin is recognized as acceptable, the trap 49 opens and the coin can pass through opening 43 toward the display 43. In the contrary case, the result of detection is subjected to a second test "coin refused?" 98. If the coin is unambiguously recognized as different from the acceptable coins, the trap 49 is maintained closed and the trap 50 is opened to permit the coin to leave through opening 44 toward display 33. If the coin is not recognized with certainty as a coin different from acceptable coins, there is effected a test "first passage?" 99. In the course of this test, it is verified whether a questionable coin, that is to say neither accepted nor rejected, has already passed through the field of action of the detector 31 while occupying the same recess 3 of the disk 2. This is effected from a knowledge of the number of recesses of the disk and by counting the cyclic disturbances created by the passage of the recesses through the field of the detector. If the response is no, which is to say if the questionable coin has made its first passage through the field of the detector, its position is memorized in the cycle (step 101), and it is returned to the field of action of the detector (step 94) to give it a new chance at identification. It is just the step of memorization 101 which then permits counting the passages of the recesses below the detector 31 until the second passage of the coin. If during the second passage the coin is positively accepted or rejected, this memorization is then erased. If during the second passage the coin is once more questionable, it is sent toward the passage opening 44 ("NO" outlet to the test 99).

The display 33 is an annular display surrounding the separator 1 and it comprises three presentation regions **54*a*, 54*b* and 54*c* angularly distributed about the axis of the disk 2 (FIG. 2**).

Each presentation region **54*a*, 54*b*, 54*c* comprises two compartments 56 and 57 for the coins which are respectively accepted and rejected. The compartments have the shape of segments of a circle. A central rib 58, of generally circular shape, separates the compartments 56 situated radially outwardly and the compartments 57 situated radially inwardly. Two other ribs of generally circular shape 59 and 61 limit radially outwardly the compartments 56 and respectively radially inwardly the compartments 57. The ribs 58, 59 and 61 are secured to the frame 8 of the apparatus, as is also a plate 62** on which the coins rest and can slide.

The inner peripheral rib 61 and the central peripheral rib 58 have, for the passage of accepted coins, two passages 63 and 64 aligned opposite the opening 43 according to the oblique path desired relative to the local radial direction from the recess 46 toward the radially outer compartments 57 for the accepted coins.

Moreover, the radially inner rib 61 has, after the passage 63 in the direction of movement F of the recesses, a second passage 64 facing the passage opening 44 for the passage of coins from the recess 47 into the radially inner compartments 57 for rejected coins.

The display regions **54*a*, 54*b* and 54*c* are separated by partitions. There are in particular three outer partitions 68 which separate from each other the radially outer compartments 56 and extend between the central rib 58 and the outer peripheral rib 59. The partitions also comprise three inner partitions 69 which separate from each other the radially inner compartments 57 and which extend between the central rib 58 and the inner peripheral rib 61. The partitions 69 are of relatively great circumferential length and are traversed each by a corridor 71**.

The partitions 68 and 69 are secured to the lower face of a transparent cover 72 which is of annular shape and of which, for reasons of clarity, is shown (by small crosses) only a fragment of the radially external edge 73 located radially beyond the outer peripheral rib 59, and a portion of the radially inner edge 74 which is about adjacent to the inner peripheral rib 61.

For its positioning, the cover 72 rests on three carrier rollers 76 with radial axes, supported in rotation by the frame 8, and it is centered between three centering rollers 77 bearing on the outer peripheral edge 73 of the cover 72. The three carrier rollers 76 rotate freely, as well as two of the centering rollers 77, which are supported by the frame 8 of the apparatus.

The third centering roller 77 (at the upper right of FIG. 2) is supported in rotation by a clevis 78 which is pressed by a spring 79 such that the roller 77 tends to bear resiliently both against the peripheral edge 73 of the cover 72 and against the output shaft 81 of an electric motor 82 (FIG. 4) for driving in rotation the cover 77 about the axis of the disk.

By control means, not shown, the motor 82 is actuated to cause the cover 72 to turn a third of a rotation in the direction of arrow F each time a payment is made. When the cover 72 is stopped, as shown in FIG. 2, there is a partition 68 which is located just in front of the passage 64 provided in the central rib 58, and a partition 69 which is stopped just in front of the passage 67 through the internal peripheral rib 61, while the corridor 71 of the same partition 69 extends obliquely downwardly, relative to the local radial direction, from the passage 63 through the internal peripheral rib to the passage 64 through the central rib 58.

The presentation region (54*a* in FIG. 2) which is rearwardly limited by the two partitions 68 and 69 located in the position which has been described, that is, just before the passage 64 and respectively the passage 67, is located in a so-called reception position for the coins. Thus, if a coin is permitted to leave by the separator through the passage opening 43, it will reach by gravity the outer radial compartment 56 of the region 54*a* after having cleared the passage 63, the corridor 71 and the passage 64. Moreover, a coin permitted to leave the separator through the opening 44 as explained above the passage 67.

During this time, another presentation region, 54*b*, will be located in presentation position, in which one can see the coins contained in the two compartments 56 and 57 of this region, coins which correspond to the preceding payment. During this time, the third presentation region 54*c* is located in reaches transmission position: the partitions 68 and 69 which delimit the rear of this region (upper left in FIG. 2) have pushed the coins corresponding to a payment through the openings 83 and 84 leading respectively to a collection box and to means to return the rejected coins to the user. In a manner not shown in detail, the opening 83 can be closed, for example if the corresponding box is full, in which case the coins will be evacuated through a second opening 46 leading for example to another box.

Each time a payment has been made, the motor 82 is controlled to turn the cover 72 a third of a turn, so that the presentation region which was located in reception position moves to presentation position, and that which was located in presentation position move to transmission position, and that which was located in transmission position returns to reception position. It is in the course of this latter movement that the coins pass through the opening 86 if the opening 83 was closed.

In the course of this movement, the coins contained in each presentation region are, at least during the rising phase of the path, pushed by the partitions 68 and 69 located behind the compartment, the descending phase taking place by gravity. It should be noted as to this that the plate 62 extends in a plane Q parallel to the plane P of the disk 2, although slightly lower relative to this latter, by a distance h, (see particularly FIG. 3) such that the coins which fall into the recess 46 or recess 47 can then slide on the plate 62 without encountering an obstacle.

It can happen that foreign bodies, more or less deleterious to the good operation of the apparatus, enter the chamber defined between the carrier surface 11 and cover 21. These could for example be objects maliciously thrown into the hopper 23. These objects are likely to damage the disk, the detector 31, the knockdown blade 39, etc.

To this end, the locking device 19 (FIG. 3) comprises an electromagnet 87 for controlling unlocking, capable of retracting stop 88 of the locking device 19 against the force of a return spring 89. When the stop 88 is retracted, the mounting 16 and with it the motor 13 and the disk 2 can pivot downwardly about the articulation 17 to the position shown in FIG. 17, the so-called discharge position, in which the disk 2 is spaced from the cover 21, from the detector 31, from the lateral guide wall 7 and from the knockdown blade 39. The disk 2 is then located in a plane $P_1$ forming with the vertical an angle B less than angle A of FIG. 3. This position is defined by bearing of the mounting 16 against an abutment 91. In this position, the falling off of foreign bodies which might be located on the disk 2 is promoted, particularly if these bodies were initially trapped by friction between the disk 2 and for example the cover 21, the knockdown blade 39 secured to the cover 21 or the detector 31 secured to the frame 8 of the apparatus. Further to promote the fall of foreign bodies, rotation of the motor 13 can be effected in opposite directions or in a single direction. This is possible because the pivoting of the mounting 16 toward the discharge position does not affect in any way the connection between the motor 13 and the disk 2. An actuator 92, for example an electromagnet, is provided to return the mounting 16 to the service position. This actuator 92 can also be utilized to shake the mounting 16 and further promote the fall of foreign bodies. When the actuator 92 is excited to return the mounting 16 to the service position, a ramp 93 secured to the mounting 16 temporarily returns the stop 88 to retracted position against the action of spring 89 until, the mounting 16 having reached the service position, the lock 88 returns to its projecting position under the action of the spring 89 and automatically locks the mounting 16.

Of course, the invention is not limited to the example shown and described.

For example, there could be used a so-called "conical" disk whose recesses are disposed along a truncated cone having an axis which can be vertical. There will thus be at all points along the periphery a slope thanks to which the coins tend to displace radially outwardly of the disk. In such a case, the annular display has itself preferably a truncated conical shape.

The traps 49 and 50 could be replaced by pivoted blades, or even by small openings provided in the lateral guide wall.

I claim:

1. Apparatus for automatic payment, comprising a payment (1) having a disk (2) which is provided with recesses (3) to receive coins or tokens and which is movable in rotation to cause the coins or tokens to pass through the field of action of a detector (31) then opposite at least one passage opening toward a display (33) which comprises partitions (68, 69) to define several regions (54*a*, 54*b*, 54*c*) about the disk (2) for display of the coins or tokens, and drive means (81, 82, 77) of the partitions (68, 69) to cause these regions to pass cyclically through a reception position for the coins or tokens away from the separator (1) and a position for transmission of the coins or tokens to a following station, in which the display is an annular display disposed about the disk (2), the drive means effecting the cyclical displacement of said display regions (54*a*, 54*b*, 54*c*).

2. Apparatus according to claim 1, in which each display region comprises two concentric compartments (56, 57) for two categories of coins or tokens, and which are fed with coins or tokens from the separator (1), as a function of the detection effected by the detector (31).

3. Apparatus according to claim 2, in which the partitions (69) define corridors (71) which separate from each other the radially inner compartments (57) and connect the separator (1) with the radially outer compartments (56).

4. Apparatus according to claim 3, in which a fixed wall (58) of generally annular shape, separates the radially inner compartments (57) from the radially outer compartments (56) and in which each corridor (71) coincides with a passage (64) through the fixed wall (58) when the compartment (56) cleared by this corridor (71) is in reception position.

5. Apparatus according to claim 3, in which the display (33) is generally located in an inclined plane, each corridor (31) is obliquely oriented relative to a local radial direction, so as to be inclined downwardly from the top of the disk (2) toward the outer radial compartment (56) of the display region which is located in reception position.

6. Apparatus according to claim 3, in which the disk (2) and the display (33) are generally located in an inclined plane (P) and the detector (31) is located facing an upper region of the disk, and there are two passage openings (43, 44) facing a descending region of the disk, the first one (43) facing the corridor (71) clearing the external compartment (56) of the display region (54*a*) which is in reception position and the other (44) communicating with the inner compartment (57) of the display region (54*a*) which is in reception position, said other passage opening being located lower than said first passage opening and at a distance from a lower region of the disk.

7. Apparatus according to claim 1, in which the partitions (68, 69) are secured to a lower surface of an at least partially transparent cover (72) through which the coins or tokens contained in the display (33) are movable, and in which the drive means are means (81, 82, 77) to drive the cover (72) in rotation.

8. Apparatus according to claim 7, comprising three rollers (77) for centering the cover, bearing on an outer peripheral edge (73) of the cover (72), the drive means comprising a motor (82) whose output shaft (81) is connected to one of said rollers (77).

9. Apparatus according to claim 7, comprising three rollers (76) for supporting the cover, bearing against the lower surface of the cover (72).

10. Apparatus according to claim 7, in which the cover (32) is annular.

11. Apparatus according to claim 1, in which the disk (2) is supported in rotation relative to a mounting (16) articulated to a frame (8) of the apparatus to pivot between an upper service position, in which the disk (2) is generally situated in a plane (8) forming a first angle (A) with the vertical, and a lower discharge position in which the disk (2) is generally situated in a plane (P) forming with the vertical a second angle (B) less than the first angle (A), a drive motor (13) of the disk (2) is secured to the mounting (14) and the drive means of the partitions (68, 69) (81, 82, 77) as well as the centering means are disposed radially outwardly of the disk.

12. Apparatus according to claim 2, in which the centering means comprise three rollers (77) bearing on a peripheral edge (73) secured to the partitions (68, 69) and the drive means (82, 81) comprise means to drive in rotation one of these rollers (77).

13. Device according to claim 1, the detector (31) being connected to the frame (8) of the device, such that the disk (2) moves away from the detector (31) when the mounting (16) moves from the service position to the discharge position.

14. Process for recognizing objects of the type of coins, in which the objects are caused to pass through the field of action of a detector (31) belonging to a recognition device (1), and as a function of the response of the detector to the passage of each object, the object is selectively directed toward at least one outlet (43, 44) of the recognition device (1) and respectively the object is returned for a second passage through the field of action of the detector (31) and is caused to follow a predetermined cycle at its position is noted in the cycle, then at the end of the second passage the object is sent toward the outlet (43, 44) of the recognition device (1).

15. Process according to claim 14, in which through the outlet, the objects are sent toward a stepwise movable display (33) that receives in different presentation regions (54*a*, 54*b*, 54*c*) successive groups of objects, and in which there is returned for a second passage through the field of action of the detector (31) an object arriving opposite the outlet (43, 44) during the time the display (13) is in the course of moving through one step.

16. Process for recognizing objects of the type of coins, comprising detecting whether the objects are clearly acceptable or clearly unacceptable or ambiguous in that they are neither clearly acceptable objects to one outlet (43) of a recognition device (1), directing said clearly unacceptable objects to another object (44) of said recognition device (1), subjecting said ambiguous objects to a second detection, directing objects found to be ambiguous upon the first detection but found to be clearly acceptable upon said second detection to said one outlet (43), and directing all of the remaining coins subjected to said second detection to said second outlet (44).

17. Process according to claim 16, in which said objects are caused to follow a predetermined cycle and the position of objects subjected to said second detection is noted in the cycle, and using the noted position in the cycle of said objects which, upon said second detection, are found to be ambiguous, to divert the latter objects to said second outlet (44) and to prevent said latter objects from undergoing further detection.

* * * * *